United States Patent [19]

Hanna

[11] 4,405,247

[45] Sep. 20, 1983

[54] FULLY SELF-CONTAINED DISPOSABLE CARTRIDGE FOR INKED RIBBONS AND THE LIKE

[75] Inventor: Samuel Y. Hanna, Nashua, N.H.

[73] Assignee: Centronics Data Computer Corp., Hudson, N.H.

[21] Appl. No.: 157,496

[22] Filed: Jun. 9, 1980

Related U.S. Application Data

[63] Continuation of Ser. No. 912,077, Jun. 5, 1978, abandoned.

[51] Int. Cl.[3] ..... B41J 33/10

[52] U.S. Cl. ..... 400/196.1; 400/195

[58] Field of Search ..... 400/194, 195, 196, 196.1, 400/207, 208

[56] References Cited

U.S. PATENT DOCUMENTS

| | | | |
|---|---|---|---|
| 539,683 | 5/1895 | Johns | 400/196.1 |
| 764,342 | 7/1904 | Booth | 400/196.1 |
| 3,758,012 | 9/1973 | Bonner et al. | 400/196 X |
| 3,814,231 | 6/1974 | Cappotto | 400/196.1 X |
| 3,871,507 | 3/1975 | Perry et al. | 400/196.1 X |
| 3,904,015 | 9/1975 | Boyden et al. | 400/196.1 X |
| 3,904,017 | 9/1975 | Frechette | 400/208 X |
| 3,905,465 | 9/1975 | Frechette et al. | 400/208 X |
| 3,941,231 | 3/1976 | Matuck et al. | 400/196.1 |
| 3,973,707 | 8/1976 | Pratt et al. | 400/196.1 X |
| 3,989,132 | 11/1976 | Carson, Jr. | 400/196.1 X |
| 4,083,444 | 4/1978 | Salto | 400/208 |
| 4,084,503 | 4/1978 | Pylant et al. | 400/196.1 X |
| 4,088,218 | 5/1978 | Depew | 400/196.1 X |
| 4,091,913 | 5/1978 | Ku et al. | 400/196.1 X |
| 4,130,367 | 12/1978 | Guerrini et al. | 400/196 X |
| 4,131,372 | 12/1978 | Hengelhaupt | 400/196.1 |
| 4,210,403 | 7/1980 | Mazouet et al. | 400/196.1 |

FOREIGN PATENT DOCUMENTS

| | | | |
|---|---|---|---|
| 2148950 | 4/1973 | Fed. Rep. of Germany | 400/196.1 |
| 2309341 | 11/1976 | France | 400/196.1 |
| 2368365 | 5/1978 | France | 400/196.1 |
| 2423341 | 11/1979 | France | 400/196.1 |

OTHER PUBLICATIONS

IBM Technical Disclosure Bulletin, "Endless Fold Ribbon Cartridge," Gardineer, vol. 15, No. 2, Jul. 1972, p. 543.

IBM Technical Diclosure Bulletin, "Ribbon Cartridge Exit Impedance," Dowd, vol. 20, No. 11B, Apr. 1978, pp. 4739-4740.

*Primary Examiner*—Ernest T. Wright, Jr.

*Attorney, Agent, or Firm*—Kenway & Jenney

[57] ABSTRACT

A lightweight, inexpensive and yet highly reliable, fully self-contained cartridge for inked ribbons having a drive assembly which "stuffs" the inked ribbon into the ribbon storage region in a full-fan-fold fashion. The storage region is substantially U-shaped and the size of the storage region, coupled with the full-fan-fold configuration of the ribbon provides a significant increased ribbon packing density. The U-shaped storage region substantially surrounds and embraces the print head, making efficient use of the central region of the cartridge.

The outfeed end of the ribbon storage region is provided with a pair of posts and terminating projections which are spaced relative to one another so as to accommodate ribbon folds in the spaced regions as the ribbon is being fed to enable the ribbon to be moved across the printing location in a smooth manner.

Drive means are provided to assure that the portion of the ribbon being "stuffed" into the storage region retains the full-fan-fold arrangement.

2 Claims, 8 Drawing Figures

FULLY SELF-CONTAINED DISPOSABLE CARTRIDGE FOR INKED RIBBONS AND THE LIKE

BACKGROUND OF THE INVENTION

This is a continuation of application Ser. No. 912,077, filed June 5, 1978 now abandoned.

The use of inked ribbon cartridges has been growing increasingly over the years due to the fact that they are simpler to mount upon and remove from a printer or typewriter than are the conventional take-up and supply spools, and further due to the fact that cartridges reduce the number of components required for support and driving of the ribbon, as well as reducing the number of steps required for a ribbon changing operation.

However, present day ribbon cartridges are not capable of yielding good print quality over a long useful operating life. In addition, many of the present day ribbon cartridges are still complicated to mount and they still smudge or soil the operator's fingers and/or clothing during installation.

It is further desired to provide a cartridge design which assures precision alignment of the operating components and which reduces any "drag" imposed upon the inked ribbon to a practical minimum.

One approach to increasing the life of a ribbon cartridge is to provide existing cartridges with re-inking apparatus. Re-inking devices have a number of shortcomings, one of which is that the saturated re-inking roller typically used in re-inking devices has been found to give up less than 10% of its ink to the ribbon and hence the re-inking roller is thrown away when the ribbon is worn out, with better than 90% of the ink still being carried by the roller, resulting in an inefficiently designed cartridge.

Another problem with re-inking structures for re-inking the ribbon results from the fact that the ink must have a relatively low viscosity in order to be assured that there will be a transfer of ink from the re-inking roller to the ribbon. This solution creates a serious problem with respect to the fact that the low viscosity ink which transfers to the ribbon is also picked up by the printing wires of the print head. The low viscosity ink works its way back along the peripheral surfaces of the wires by capillary action to enter into the print wire bearings. Over a period of time certain components within the ink cause the print head to deteriorate and fail prematurely. This problem does not occur with ribbons that are not re-inked since the original ink has a much greater viscosity and is more dry than ink used in re-inking devices so that substantially all of the ink transferred to the printing tips of the print wires is transferred to the paper document which is being printed upon, so that almost none of the ink travels backwards along print wire so as to have very little affect upon the print head itself.

The most significant aspect of the printer to be controlled is the wearing of the printing tips of the print wires. The print wire tips impact the ribbon, paper document and backing platen with a significant force, which is sufficient to create significant pressures and also to develop a significant amount of heat upon each impact. The combination of heat, pressure and the chemical reactions of the ingredients of the ink upon the print head have a very significant effect upon the wearing of the printing wire tips. Thus the print wires actually shorten through continued use until eventually the print wires will shorten to an extent that they will not reach the paper document and backing platen so as to no longer be capable of printing. The typical throw of a print wire is of the order of 15–20 thousandths of an inch, i.e., the print wire moves from the non-impact position to the impact position over a distance of the order of 15–20 thousandths of an inch. Since this distance is relatively small, it can be seen that even minor wearing of the print wire tip can have a significant effect upon the "throw" of the print wire, and certainly upon the impact force clearly having a significant effect upon the print quality and the useful operating life of the print head. The ink composition of printing apparatus is typically comprised of pigment and a vehicle in which the pigment is dispersed. The vehicle contains acids and/or acidic solutions which tend to have a significant effect on the wearing of the print wires. Re-inking solutions contain lesser amounts of pigment and greater amounts of vehicle in order to obtain the lower viscosity needed for ease of ink transfer to the ribbon, which is a basic requirement in re-inking apparatus. As a result, wearing of the print wires is greatly accelerated when printing with all types of ribbon apparatus having re-inkers.

When using cartridges with re-inking devices, it has been found that the ink transferred from the re-inking roller to the ribbon is a non-uniform manner, thereby having a distinct effect upon the print quality. In addition thereto, due to the low viscosity of the ink, some of the ink will transfer over to the drive rollers within the cartridge to significantly reduce their operational effectiveness.

BRIEF DESCRIPTION OF THE INVENTION

The present invention overcomes all of the disadvantages pointed out hereinabove and is characterized by providing a lightweight, disposable type, fully self-contained cartridge having a ribbon packing density capable of holding over seventy (70) yards of inked ribbon. These advantages are obtained through a design which includes a ribbon cartridge having a substantially U-shaped ribbon storage region, and drive means for "stuffing" the ribbon into the storage region inlet end so as to store the ribbon within the storage region in a full-fan-fold fashion. The ribbon drive assembly utilizes smooth driving surfaces which engage one another to form a nip for feeding ribbon therebetween, the idler roller being resiliently mounted and biased to engage the surface of the drive roller. The smooth surfaces cooperate to assure "stuffing" of the ribbon into the storage area in full-fan-fold fashion while at the same time enabling the ribbon to slip relative to the drive and idler rollers to prevent tearing of the ribbon in the event that the ribbon encounters a momentary "snag".

Storage of the ribbon in full-fan-fold fashion is defined herein describing the configuration of the ribbon in the storage region, said configuration having loops (hereinafter referred to as "folds" ) at spaced intervals along the length of the ribbon. Alternating folds extend to and preferably slidably engage opposite side walls of the ribbon storage region. This arrangement is uniformly provided throughout the ribbon storage region. The folds are in the form of smoothly curved loops, to enable the ribbon to resume a flat or straight configuration as it passes through the printing location. Sharp creases are not capable of returning to a flat shape and quite frequently the creases will be grabbed by or will catch upon the print wires during printing. Since the print wires strike the ribbon thousands of times per second, even a momentary halt in the feeding of the ribbon may cause the ribbon to be punctured and/or torn by the print wires. The drive means of the present invention thus provides a high ribbon packing density while assuring a neat fan-fold configuration with smoothly rounded loops to assume highly reliable feeding of the ribbon throughout the cartridge.

The full-fan-fold arrangement, in addition to providing an orderly arrangement of the ribbon, also provides a packing density which far exceeds that obtained in cartridges in which the ribbon is coiled or in which the ribbon is stuffed into a ribbon storage region in a random fold fashion. In addition thereto, the smoothly finished ribbon guiding surfaces further assure that the ribbon will not experience any creasing during the "stuffing" operation.

The storage region is substantialy U-shaped so as to take full benefit of the cartridge configuration which surrounds the print head an makes maximum, and hence, most efficient use of the cartridge housing for maximizing ribbon packing density and cartridge capacity. The width of the storage region is substantially constant over the entire length thereof to provide a substantially uniform fan-fold arrangement over the length of the storage region. The inner perimeter of the storage region is provided, at a point near the outfeed end, with an obstruction or "dam" for effectively "slowing down" the movement of ribbon folds passing over the "dam" which curves inwardly toward the opposite wall of the storage region to assure that the ribbon will fill the entire storage region adjacent the outfeed end to maximize the packing density as well as preventing the feeding of one side of the fan-folds to the outfeed end at a point earlier in time than the feeding of the opposite side of the ribbon fan-folds which, if such a condition were allowed to occur, many of the folds may be forced into the region of the outfeed opening which would lead to creasing of the fan-folds reaching the outfeed end prematurely, as well as jamming of the ribbon which can further lead to possible tearing of the ribbon by the print wires.

The outfeed end of the storage region is provided with a pair of diagonally aligned projections and a pair of posts which are adapted to release each fold within the spaced region between the end of each projection and its adjacent post so as to cause the ribbon which ultimately leaves the storage region by passing between the aforesaid posts, to leave the storage region in a smooth manner and without "jerking". The large spacing between the posts assures that the ribbon will not be creased even if more than one ply of the ribbon enters into the region between said posts during the feeding of ribbon therebetween.

The ribbon, in moving away from the aforesaid posts and out of the outlet opening of the cartridge, passes through a totally enclosed region in which the ribbon undergoes two half twists, the first twist occurring before the ribbon passes between a pair of drag-imposing projections while the second twist occurs after the ribbon passes beyond the drag-imposing projections. The ribbon moves through the outlet opening of the housing and across a print station where it is arranged to move across the nose of a print head before entering into the inlet opening of the cartridge and moving into and between the influence of the ribbon drive assembly. By fully enclosing the ribbon within the region where the first and second twists occur, the housing protects the ribbon from becoming "snagged" upon any external components while at the same time imposing some "drag" upon the ribbon so as to further assure that it will be fed across the printing region in a smooth, unjerky manner.

The cartridge is provided with a pair of snap-fitting projections which are adapted to releasably embrace the forward end of a print head so as to "lock" th printing region of the cartridge with the print head nose to substantially eliminate any movement of the ribbon cartridge relative to the printing nose of the print head, which could have a harmful effect upon print quality.

The inked ribbon re-enters the cartridge housing after passing the print station and projections are provided therein for reducing the amount of surface contact between the inked ribbon and the cartridge components to a practical minimum.

The inked ribbon cartridge design in accordance with the above principles has been found to give excellent, trouble-free service. The components are extremely light in weight and inexpensive to produce while at the same time providing a smoothly operating, trouble-free cartridge requiring fewer replacements per operating unit of time so as to be significantly advantageous for use as compared with conventional cartridges.

OBJECTS OF THE INVENTION AND BRIEF DESCRIPTION OF THE FIGURES

It is therefore one object of the present invention to provide a fully self-contained cartridge for inked ribbons and the like for use in printing systems in which the inked ribbon is stored in full-fan-fold fashion within a substantially U-shaped storage area.

Another object of the present invention is to provide a novel fully self-contained cartridge for inked ribbons and the like, and including a storage area for storing the inked ribbon in full-fan-fold fashion and having an outlet end which prevents the ribbon from being creased as it exits the storage area.

Still another object of the present invention is to provide a novel fully self-contained cartridge for inked ribbons and the like, including means for advancing the ribbon past the print station and for stuffing the ribbon into the storage area in full-fan-fold fashion.

The above as well as other objects of the present invention will become apparent when reading the accompanying description and drawing in which:

FIG. 1 shows a top plan view of an inked ribbon cartridge designed in accordance with the principles of the present invention, and showing the cover removed to facilitate an explanation of the design and operation thereof;

FIG. 1*a* shows a side elevational view of the cartridge of FIG. 1, looking in the direction of arrows 1*a*—1*a*;

FIG. 2*a* shows an elevational view of the printing position of the cartridge of FIG. 1, looking in the direction of arrows 2*a*—2*a*;

FIG. 2*b* shows a top plan view of the printing portion of the cartridge of FIG. 2*a*;

FIG. 2*c* shows an elevational section of the ribbon turning members of FIG. 1, looking in the direction of arrows 2*c*—2*c*;

FIG. 2*d* shows an enlarged detailed view of the ribbon drive assembly of FIG. 1;

FIG. 2*e* shows an exploded sectional view of the spring biased stripper member for the idler roller subassembly of the drive assembly of FIGS. 1 and 2d, and looking in the direction of arrows 2e—2e in FIG. 2d; and FIG. 2f shows an elevational section of the ribbon drive assembly of FIGS. 1 and 2d.

DETAILED DESCRIPTION OF THE INVENTION

Figure 1:
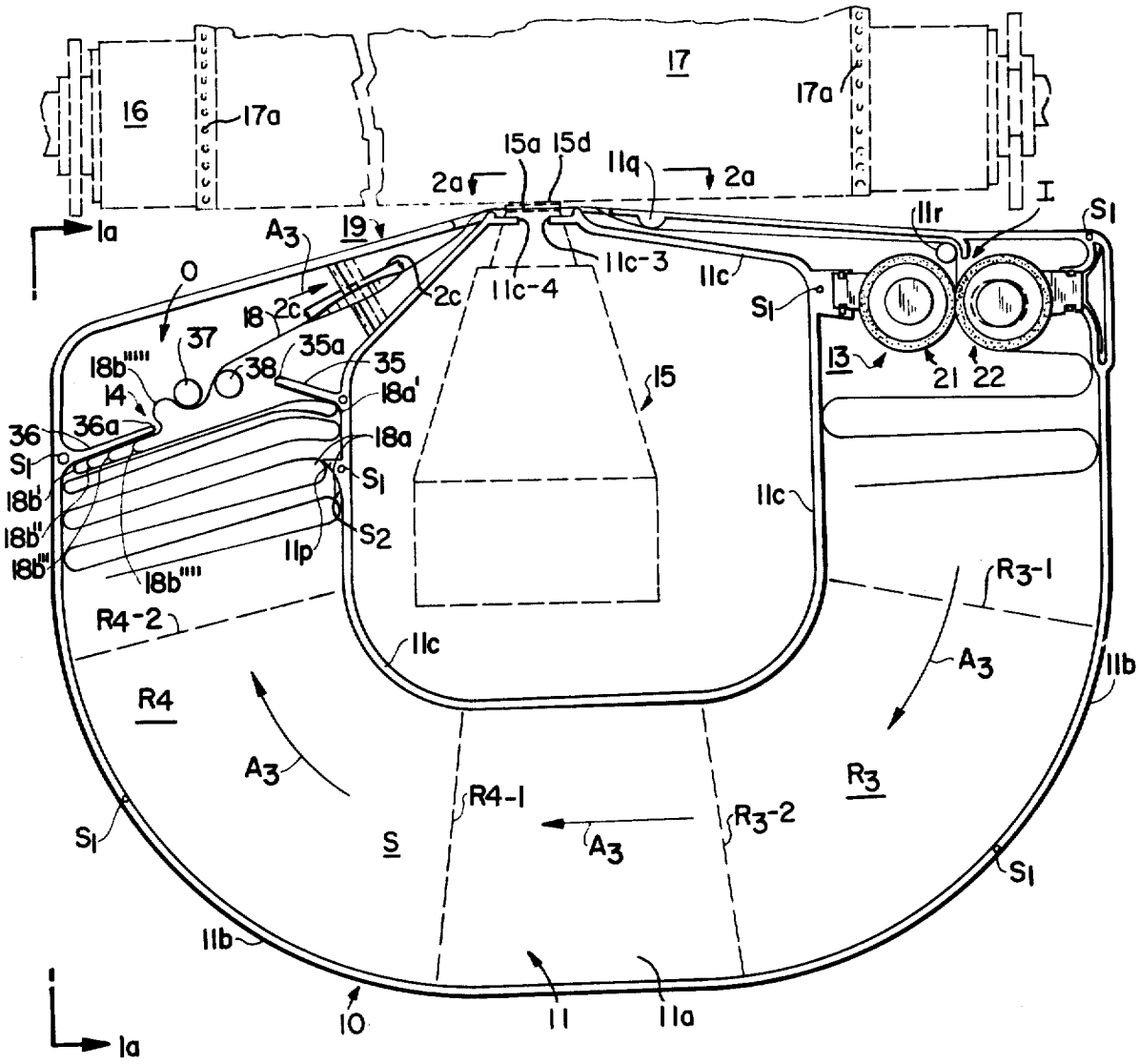
Figure 1A:
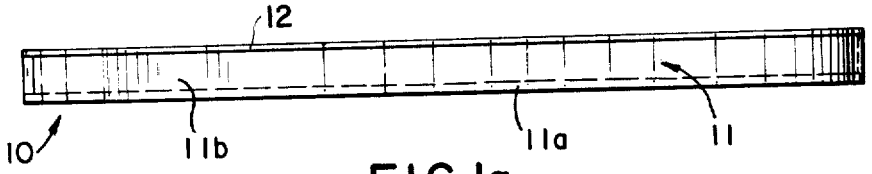

FIG. 1 shows a cartridge assembly 10 embodying the principles of the present invention, and including a housing lower half 11 having a base or floor 11a. The outer periphery thereof is provided with an upright wall 11b while the inner periphery is provided with an upright wall 11c. The housing lower half 11 mates with a top half lid or cover member 12 having a peripheral configuration substantially identical to the configuration of the housing lower half 11.

The inner and outer walls 11c and 11b cooperate with the floor or base portion 11a and lid 12 to define a hollow interior storage region S of a substantially U-shaped configuration and extending between an inlet end I defined by a drive assembly 13 and an outfeed end O defined by an outlet guiding arrangement 14, said drive assembly 13 and outlet guiding arrangement 14 to be more fully described hereinbelow.

The inner upright wall 11c defines a space which is occupied by a print head assembly 15 mounted upon a carriage assembly (not shown) for moving the print head assembly 15 as well as the cartridge assembly 10 relative to a paper document supporting platen 16 adapted to support an elongated paper web 17 of indeterminate length. The cartridge assembly 10 and print head assembly 15 are mounted upon the above-mentioned carriage assembly to move from left to right and from right to left during printing operations so as to print a line of characters. The print head assembly 15 may, for example, be that employed in an impact printer of the dot matrix type. However, any other type of printer may be utilized in which the print head assembly 15 may be accommodated within the open region defined by the cartridge housing inner wall 11c.

The paper web 17 is preferably provided with a plurality of spaced openings 17a along its left and right-hand margins to assure accurate and positive advancement of the web 17 during printing, especially when employed in high-speed printing and/or paper slewing operations.

The height of the hollow interior storage region S, referred to hereinabove, is sufficient to store an inked ribbon 18 which is formed into a continuous, closed Mobius loop and except for a small length of ribbon 18 passing through the ribbon turning assembly 19, the ribbon 18 is stored in an upright fashion so that the plane of the ribbon 18 is substantially perpendicular to the base 11a of housing lower half 11 so that the lower edge of the ribbon 18 rests upon base 11a and the upper edge lies beneath the interior surface of the cartridge housing lid 12.

Inked ribbon 18 enters into the storage region S through the ribbon drive assembly 13 which, as can best be seen in FIGS. 1 and 2d–2f, is comprised of a drive roller assembly 21 and an idler roller assembly 22 which cooperate to form a nip N between the peripheries of the drive roller assemblies 21 and 22 which applies a squeezing force upon the ribbon 18 passing through the nip N, so as to drive the ribbon 18 in the direction shown by arrow A1.

The drive roller assembly 21 is comprised of a one-piece molded member M, preferably formed of plastic, having an upper rodshaped portion 23a whose cylindrical surface is knurled, as shown. A first disc-shaped portion 23b is integrally joined to the lower end of knurled portion 23a. A second disc-shaped portion 23d is integrally joined to the first disc-shaped portion 23b by an intermediate cylindrical portion 23c. A lower cylindrical shaped projection 23e extends downwardly from disc-shaped portion 23d and is provided with an axially aligned rectangular shaped bore 23f which extends into the disc-shaped portion 23d so as to receive a similarly shaped projection 25a, provided at the upper end of a drive shaft 25 which forms an integral part of the printer and which extends upwardly through an opening in the carriage upon which the linked ribbon cartridge assembly 10 and the print head assembly 15 are mounted. The knurled portion 23a of the drive roller assembly 21 is adapted to be gripped by the fingers of an operator in order to rotate member 23 for the purpose of aligning the rectangular shaped bore 23f with the rectangular shaped projection 25a of the ribbon drive shaft 25.

The drive roller assembly 21 is rotatably mounted by means of an opening 12a provided in lid 12, which opening 12a surrounds the base of the knurled portion 23a. A circular opening 11d is provided in the base 11a of the housing lower half 11 and surrounds the lower cylindrical projection 23e to free-wheelingly mount the drive assembly member 23.

O-rings 26 and 27 are arranged around the circular peripheries of disc-shaped portions 23b and 23d. The O-rings 26 and 27 are formed of a resilient compliant material such as a rubber, or rubber-like plastic material and have square cross-sectional configurations. The O-rings 26 and 27 are mounted by stretching the O-rings 26 and 27 over the outer peripheries of disc-shaped portions 23b and 23d so that the O-rings 26 and 27 constantly experience a finite amount of expansion or stretching from their normal unstretched state in order to maintain the O-rings 26 and 27 about their cooperating disc-shaped portions 23b and 23d in a secure manner. If desired, a suitable glue or adhesive material may be provided between the mating surfaces of the disc-shaped portions 23b and 23d and the O-rings 26 and 27. After assembly, the O-rings 26 and 27 are machined so as to be as close to an ideal round shape as is possible and of a diameter whose value lies within a predetermined tolerance range.

The base 11a of housing lower half 11 is provided with an upwardly extending portion 11e having a pair of substantially rectangular shaped upwardly extending projections 11f and 11g which are adapted to embrace similar shaped notches 28a and 28b provided at the left-hand end of a stripper member 28, whose opposite end is provided with a pair of arms 28c and 28d whose inner peripheries collectively form an arcuate periphery 28f which is slightly greater than one-half of a full circle in order to snap-fittingly receive cylindrical portion 23c. Member 23 is free to rotate relative to stripper member 28 due to the low coefficients of sliding friction of member 23 and member 28, which are preferably formed of a plastic material having a low coefficient of sliding friction. One suitable material is nylon.

A projection 12c is provided along the interior surface of cover member 12 and is adapted to rest upon the upper surfaces of projections 11f and 11g, facing the aforesaid projection 12c , in order to retain stripper member 28 within the housing lower half 11 so as to prevent movement of the stripper member 28 in the vertical direction. A similar projection 12c is described with regard to stripper member 28'. The projections 11f and 11g prevent the stripper member 28 from experiencing any rotary or swinging motion.

The idler roller assembly 22 is substantially similar to that of the drive roller assembly 21 and is comprised of a one-piece molded plastic member 30 having an upper cylindrical shaped projection 30a integrally joined to an upper disc-shaped portion 30b which, in turn, is integrally joined to an intermediate cylindrical shaped portion 30c, which is integrally joined to a lower disc-shaped portion 30d having a lower cylindrical shaped portion 30e integrally joined thereto.

The lid 12 is provided with a substantially oval shaped opening 12b for receiving cylindrical shaped projection 30a, and so as to provide a controlled amount of "play" therebetween, for a purpose to be more fully described. A similar substantially oval shaped opening 11k, provided in the base 11a of the housing lower half 11, is aligned with opening 12b and is arranged to receive the lower cylindrical shaped portion 30e of member 30. O-rings 32 and 33 are positioned about the outer peripheries of the disc-shaped portions 30b and 30d in much the same manner as that shown for the drive roller assembly member 23 and O-rings 26 and 27.

The cylindrical portion 30c member 30 is snap-fittingly received by stripper member 28', which is substantially identical in design and function to the stripper member 28. The left-hand end of stripper member 28' is provided with arms 28c' and 28d' which collectively form an interior periphery 28f' of greater than one-half of a full circle so as to snap-fittingly receive the intermediate cylindrical portion 30c of member 30.

Figure 2A:
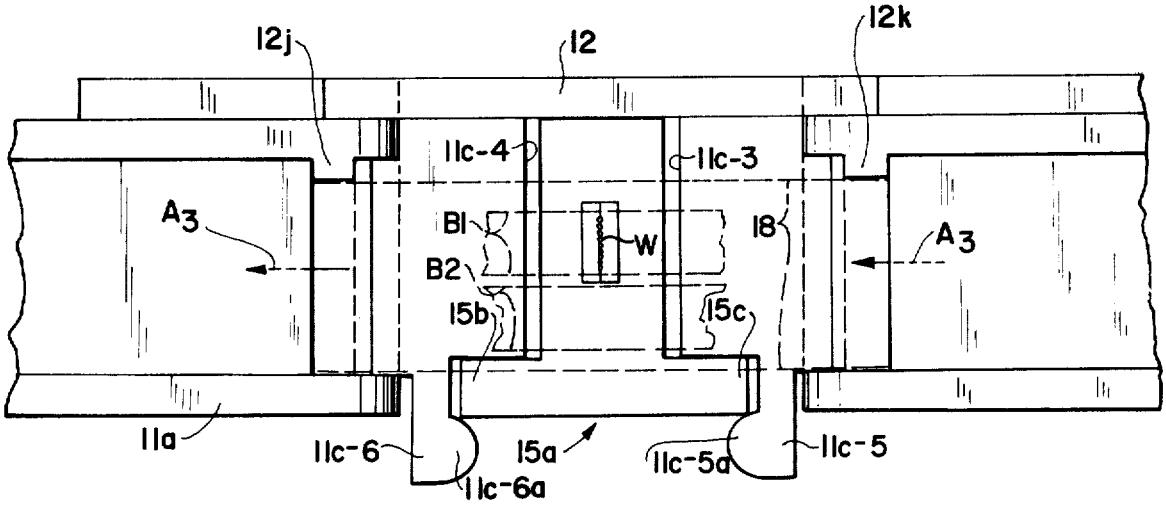
Figure 2B:
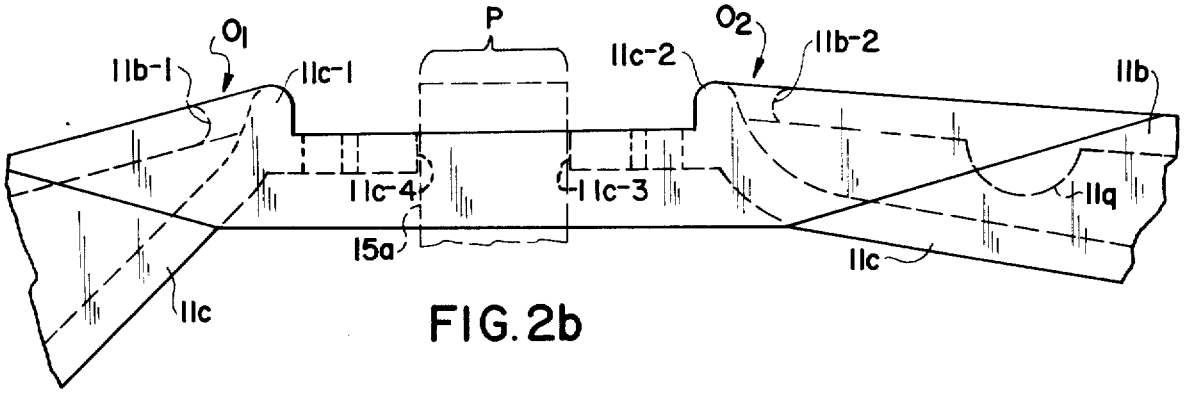
Figure 2C:
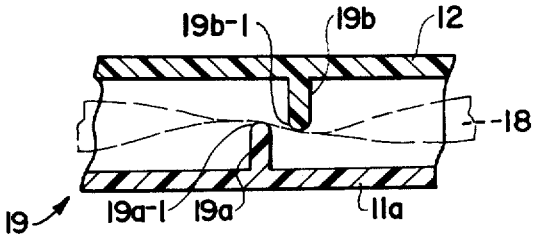
Figure 2D:
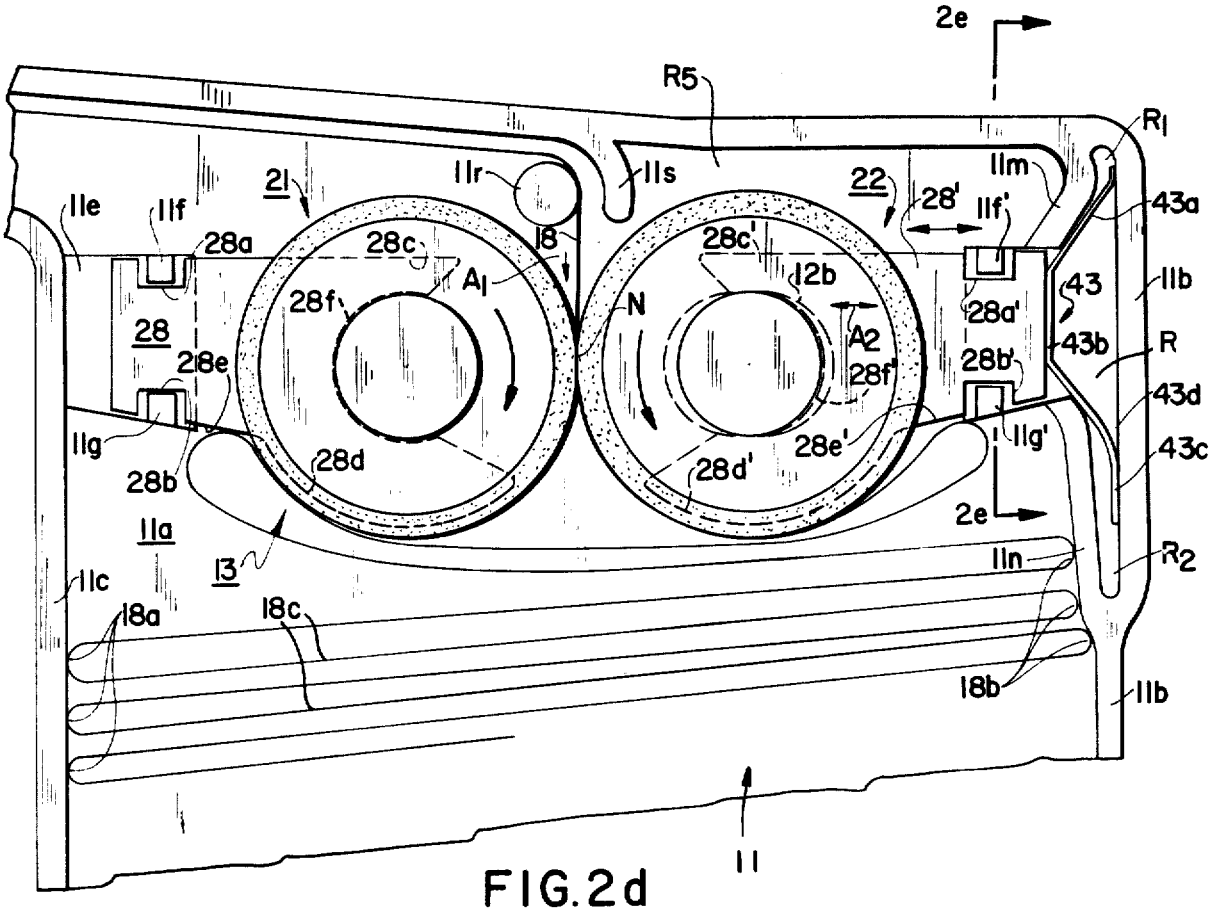
Figure 2E:
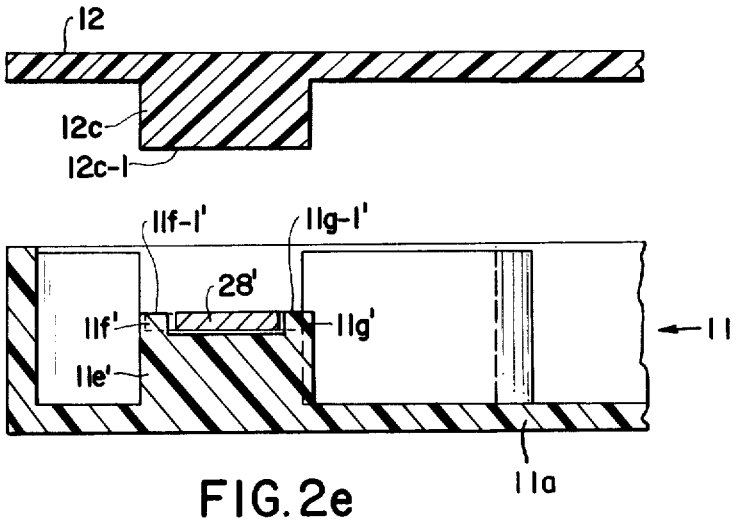
Figure 2F:
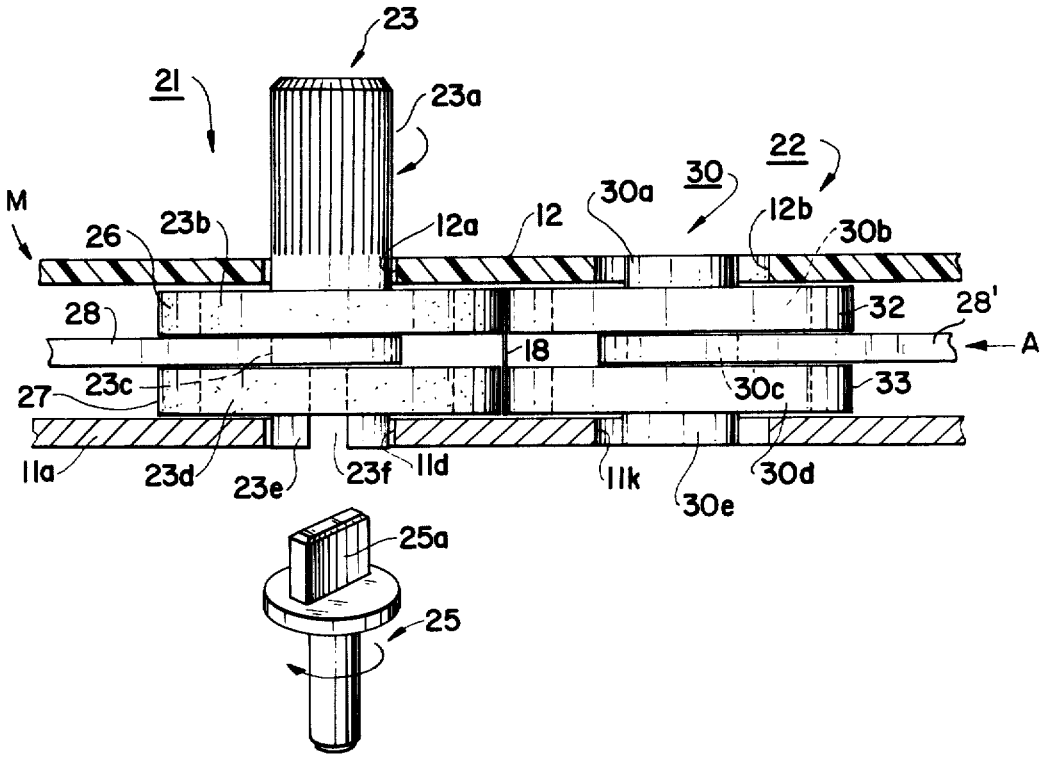

The right-hand end of stripper member 28' is provided with notches 28a' and 28b', similar to the notches 28a and 28b of the stripper member 28 as can best be appreciated from FIG. 2d.

The base 11a of the housing lower half 11 is provided with a pair of projections 11f' and 11g' which are arranged upon a raised portion 11e', which portions are substantially identical to raised portion 11e and projections 11f and 11g described hereinabove. The stripper assembly 28' slides upon the raised portion 11e' and is secured against movement in the vertical direction between the upper surface of raised portion 11e', the upwardly extending projections 11f' and 11g' and the downwardly extending projection 12c of housing cover member 12. The bottom surface 12c-1 of downwardly depending projection 12c rests upon the upper surface 11f-1' and 11g-1' of projections 11f' and 11g' so as to prevent the stripper member 28' from experiencing any movement in the vertical direction (relative to FIG. 2e). However, since the notches 28a' and 28b' are significantly wider than the projections 11f' and 11g', the stripper member 28' is free to move in the opposing directions, shown by double-headed arrow A2 in FIG. 2d. Elongated oval shaped openings 12b and 11k, provided in housing cover members 12 and base 11a, respectively, cooperate with the slidable stripper member 28' to permit a controlled amount of slidable movement. Since the drive roller assembly 21 has no oval shaped openings, neither stripper member 28 nor roller member 23 experiences any movement in either direction as shown by arrow A1 (see FIG. 2d).

The idler roller assembly 22 is normally biased toward the drive roller assembly 21 by means of a leaf spring member 43 arranged within a recess R defined by one portion of outer wall 11b and a pair of projections 11m and 11n integrally joined to and extending inwardly from outer wall 11b, and of a configuration adapted to provide narrow recesses R1 and R2 for respectively receiving the upper end 43a and lower end 43c of leaf spring 43. The intermediate portion 43b of leaf spring 43 bears against the right-hand surface of stripper member 28' to urge the stripper member 28', and hence the idler roller assembly member 30, toward the drive roller assembly 21. The lower end 43c of leaf spring member 43 experiences a bend at 43d in oreder to fit within recess R2. As an alternative arrangement, leaf spring member 43 may be replaced by a helical type spring, if desired.

The surfaces of O-rings 26, 27, 32 and 33 are smooth and hence the biasing force of spring member 43 is required in order to impart suficient drive to the portion of the inked ribbon 18 passing through the nip N formed by the engaging surfaces of the cooperating O-rings 26, 27, 32, and 33. The importance of this arrangement is to assure that the inked ribbon 18 will not become creased or torn for any reason since, if any drag is imposed on the ribbon 18 as it passes through the cartridge assembly 10, and especially through the printing station P, the drive roller assemblies 21 and 22 will be free to slip relative to the halted ribbon 18 to prevent the ribbon 18 from being unduly stretched or torn in the event that the force or element imposing the drag upon the ribbon 18 has totally halted movement of the ribbon 18 at the point where the snag has occurred.

Another very important reason for providing the O-rings 26, 27, 32 and 33 with smooth outer peripheries is to be assured of forming full-fan-fold of the ribbon 18 within the hollow storage region S. The ribbon 18 is preferably a fabric ribbon impregnated with ink as well as other ingredients to keep the ink from drying out, to assure good transfer of ink from the ribbon 18 to the paper 17 during printing, etc. These ingredients cause the ribbon 18 to adhere to the surfaces of one of the two pairs of O-rings 26, 27, 32, and 33. Assuming that no ribbon storage whatsoever has occurred, the surfaces of the O-ring pairs that the ribbon 18 will adhere to will be perfectly random. In the present example let it be assumed that the ribbon 18 will adhere to the driving surfaces of the idler roller assembly O-rings 32 and 33. Although the ribbon 18 will continue to adhere to the surface, the slightest obstruction will cause the ribbon 18 to part from the driving surfaces. In the present invention, separation is caused by the ribbon striking against edge 28e' of stripper member 28'. As a result, ribbon 18 separates from the driving surfaces of the idler roller assembly 22, as shown in FIG. 2d, and will then adhere to the surfaces of the O-rings 26 and 27 in the drive roller assembly 21. The diameters of the driving peripheries, as well as the locations of the operative edges 28e' and 28e of the stripper members 28' and 28, are so related to the width of the storage region S immediately adjacent to the inked ribbon drive roller assembly 21 to cause the ribbon 18 to form a full-fan-fold arrangement, i.e., to cause each left-hand fold 18a to extend toward the interior surface of inner wall 11c and to cause each right-hand fold 18b to extend toward the interior surface of outer wall 11b, said folds 18a and 18b being smoothly curved loops as opposed to sharply creased bends. This arrangement enables the maximum amount of ribbon 18 to be stored within a given area. For example, in the present invention, by storing the ribbon 18 in a full-fan-fold fashion, it has been possible for the first time to store as much as seventy (70) yards of ribbon 18 within the cartridge assembly 10 shown in FIG. 1, the storage region S of the cartridge assembly 10 having a width of the order of 8.5 inches and a height of the order of under 6.0 inches. It is not possible to store coiled ribbon or random fold ribbon of the same length in a region as small as that of the present invention.

The folds 18*a* and 18*b* and straight portions 18*c* of the ribbon 18, as shown in FIG. 2*d*, have been grossly exaggerated with regard to actual spacing encountered, in order to facilitate an understanding of the invention. It should be understood that the substantially straight portions 18*c* of ribbon 18 between adjacent folds 18*a* and 18*b*, i.e., between left and right-hand folds 18*a* and 18*b*, engage one another over a major portion of their length. The fan-fold arrangement, however, provides smoothly curved loops at the left and right-hand folds 18*a* and 18*b* to prevent the ribbon 18 from becoming permanently creased.

The "stuffing" of the ribbon 18 into the storage region S causes each completed fold to be pushed downwardly by each new fold, so that the folded portions gradually move through the storage region S, as shown by the arrows A3. The separation distance between the inner and outer walls 11*c* and 11*b* of the cartridge housing lower half 11 is maintained substantially constant and each leg of the U-shaped storage region S has a straight portion to aid in preventing the ribbon 18 from being sharply folded or creased as it moves from the input end I of the storage region S toward the outfeed end O thereof.

Two regions or bands B1 and B2 of the ribbon 18 (see FIG. 2*a*) are driven by O-rings 26,32 and 27,33. Also, at least portions of the same two bands B1 and B2 are struck by the print wires W. The above actions cause the ribbon 18 to undergo stretching in the regions of bands B1 and B2 while remaining substantially unstretched in the regions of the ribbon 18 outside of bands B1 and B2. It is important to prevent the stretched regions of the ribbon 18 from being jammed into the region between O-rings 26,32 and 27,33. This is accomplished by rod-like projection or pin 11*r* and the arms 28*d*, 28*d*' of the stripper members 28 and 28' (see FIG. 2*d*). Pin 11*r* prevents the ribbon 18 from engaging the surfaces of O-rings 26 and 27 until the ribbon 18 reaches the region of nip N. The stripper members 28 and 28' substantially fill the regions between disc-shaped portions 23*b*,23*d* and 30*b*,30*d* and the free ends of arms 28*d* and 28*d*' extend almost to the outer peripheries of the O-rings 26,27 and 32,33 to prevent the stretched portion of the ribbon 18 which has passed the nip N, formed between the engaging O-ring surfaces of O-rings 26,32 and 27,33, from entering into the region between the O-rings 26,27 and 32,33 as well as the region between disc-shaped portions 23*b*, 23*d* and 30*b*,30*d*.

The outfeed end O is provided with an outlet guiding arrangement 14 (FIG. 1) comprised of first and second inwardly directed and diagonally aligned projections 35, 36, which are adapted to engage the folded or looped ends 18*a* and 18*b* of the ribbon 18 while the portion 18*c* of the ribbon 18 between opposite left and right-hand folds 18*a* and 18*b* is unsupported. Since the ribbon 18 moves through a turn in the region R3, defined by dotted lines R3-1 and R3-2, as well as a turn in region R4, defined by dotted lines R4-1 and R4-2, and since the folds 18*a* travel a shorter distance along inner wall 11*c* than the folds 18*b* travel along outer wall 11*b*, the folds 18*a* tend to reach projection 35 well before the folds 18*b* tend to reach projection 36. In order to correct this situation and thereby prevent the folds 18*a* from being "stuffed" or pressed into the corner between wall 11*c* and projection 35, a "dam" in the form of a gently curved surface $S_2$ along one side of an inwardly directed projection 11*p* is provided along the interior surface of interior wall 11*c*. This "dam" 11*p* or obstruction tends to slow down the movement of the folds 18*a* to allow the folds 18*b*, passing along the interior surface of outer wall 11*b*, to, so to speak, "catch-up" with the folds 18*a* and thereby prevent folds 18*a* from being pressed into the corner formed between interior wall 11*c* and projection 35 so as to prevent the ribbon 18 from becoming creased and so as to further assure smooth unobstructed movement of the ribbon 18 as it moves through the outfeed end O of the storage region S. The "dam" 11*p* also permits the outer folds 18*b* to reach projection 36*a* at about the same time the folds 18*a* reach projection 35 to thereby substantially fill the ribbon storage region S in the immediate region of projection 36. Also, projections 35 is positioned closer to the forward end of the cartridge assembly 10 than projection 36 to cooperate with "dam" 11*p* to enable folds 18*b* to "catch-up" with folds 18*a*.

Contrary to the technique employed in conventional cartridges in which the outfeed opening is quite small and is typically of a width of 0.012 inches, the ribbon 18 passes between a pair of posts 37 and 38 integrally joined with and extending upwardly from base 11*a* of the housing lower half 11, and spaced apart by a distance which is many, many times greater than the thickness of ribbon 18, and which is adapted to facilitate smooth feeding of the ribbon 18 and to prevent creasing.

The ribbon drive assembly 13 causes the ribbon 18 to be drawn out of the storage region S. As the ribbon 18 moves in a direction shown by arrow A3, the uppermost outer fold 18*b*' is moved inwardly along the under surface of projection 36, as shown at 18*b* '', 18*b*''' and 18*b*'''', until the fold 18*b*' is clear of the innermost end 36*a* of projection 36 whereupon the fold 18*b*''''' "snaps" upwardly into the region between projection end 36*a* and post 37. The fold 18*b*''''' is then pulled around post 37 and between posts 37 and 38 to move through the ribbon turning assembly 19.

In a similar fashion, the uppermost right-hand fold 18*a*' moves inwardly along the engaging surface of projection 35 until it clears the innermost end 35*a* at which time this fold 18*a*' will "snap" into the region between end 35*a* and post 38, and whereupon the ribbon 18 will move about post 38 and between posts 37 and 38 as it moves toward the ribbon turning assembly 19. The spaced regions between projection end 36*a* and post 37, and between projection end 35*a* and post 38, serve as a means for temporarily "storing" a loop as a single ply of the ribbon 18 passes between posts 37 and 38 in order to prevent the ribbon 18 from moving in a "jerking" fashion between posts 37, 38 and the ribbon turning assembly 19. In some instances, two or more adjacent folds may be "snapped" between the end of a projection 35*a*,36*a* and the post 38,37 adjacent thereto. The design of the outlet guiding arrangement 14 allows the slack, which might otherwise occur, to be taken-up so that the ribbon 18 is pulled rather smoothly from between posts 37 and 38. Even in instances where a double-fold or more than one ply of ribbon 18 is caused to pass between posts 37 and 38, the slack will be removed smoothly and, due to the spacing between posts 37 and 38, the ribbon 18 will not be creased in the process.

After the ribbon 18 leaves the region between posts 37 and 38 it undergoes a half turn, i.e., the ribbon 18 is reoriented from a vertical alignment, relative to FIG. 1, to the horizontal alignment. The first turn occurs just before the ribbon 18 passes between a pair of cooperating projections 19*a* and 19*b* extending, respectively, upward from floor 11*a* and downward from cover member 12 so that the free ends 19*a*-1, 19*b*-1 of the projections 19*a* and 19*b* slightly overlap one another. The free ends 19*a*-1 and 19*b*-1 are rounded and smoothed so that they will not impose any unreasonable "drag" upon the ribbon 18 passing therebetween. The projections 19*a* and 19*b* are substantially straight and elongated so as to extend between the outer wall 11*b* and the inner wall 11*c* of the lower half 11 of the cartridge housing. The projections 19*a* and 19*b* cause the ribbon 18 to follow an undulating path which imposes a slight "drag" which is sufficient to facilitate smooth feeding of ribbon 18 across the nose 15*a* of print head assembly 15.

As shown in FIG. 2*b*, the ribbon 18 undergoes another turn as it moves between assembly 19 and an outlet opening $O_2$ formed between an arcuate projection 11*b*-1 in outer wall 11*b* and an arcuate projection 11*c*-1 in inner wall 11*c*. The projections 11*b*-1 and 11*c*-1 and free ends 19*a*-1, 19*b*-1 are rounded and smoothed as shown so as to prevent any "drag" from being imposed upon the ribbon 18, as well as limiting the area of surface contact between the ribbon 18 and arcuate projection 11*b*-1 and arcuate projection 11*c*-1. The ribbon 18 passes between arcuate projections 11*c*-1 and 11*c*-2 in inner wall 11*c*. Projection 11*c*-2 cooperates with termination 11*b*-2 in outer wall 11*b* to form inlet opening $O_2$. The ribbon 18 passes out of opening $O_1$, across the printing region P and into inlet opening $O_2$. Inner wall 11*c* has two terminations 11*c*-3 and 11*c*-4 which are spaced apart from one another to form a recess for receiving the nose portion 15*a* of print head assembly 15. The nose portion 15*a* has a configuration as shown in dotted fashion in FIG. 2*a*, as to fit in the region defined by lid 12 and inner wall terminations 11*c*-4 and 11*c*-3.

A pair of mounting projections 11*c*-5 and 11*c*-6 extend downwardly from the terminating portions of inner wall terminations 11*c*-3 and 11*c*-4, respectively, and have rounded inwardly directed portions 11*c*-5*a* and 11*c*-6*a* which snap-fittingly receive opposite flanged portions of the print head assembly 15.

The nose portion 15*a* of print head assembly 15 has a configuration which generally conforms to the nose receiving region defined by housing cover 12 and wall terminations 11*c*-3 and 11*c*-4. Flanges 15*b* and 15*c* are snap-fittingly received between rounded mounting projections 11*c*-6*a* and 11*c*-5*a* to secure the print region P of the cartridge assembly 10 to the nose 15*a* of the print head assembly 15 to substantially prevent relative movement between the print region P of the cartridge assembly 10 and the nose 15*a* of the print head assembly 15 which might otherwise occur due to vibration experienced by the components during the movement of the carriage and the operation of the print head assembly 15.

The interior surface of the lid 12 in the region of the openings O-1 and O-2 is provided with projections 12*j* and 12*k* which extend toward base portion 11*a* to reduce the spacing between the projections 12*j* and 12*k* and the top surface of base portion 11*a* to a distance just slightly smaller (i.e., several thousandths of an inch less) than the width of the inked ribbon 18 to reduce and, preferably, to eliminate movement of the ribbon 18 in a direction transverse to the feed direction of the ribbon 18 as shown by arrows A3 in FIG. 2*a*, which, in one preferred embodiment, permits the use of a ribbon 18 having a width of 8.50 millimeters (i.e., 0.355 inch) for use with nine-pin dot matrix print heads forming a print band of 0.132 inch.

The interior surface of outer wall 11*b* is provided with a semi-circular shaped projection 11*q* which extends inwardly and toward the inner wall 11*c*. This projection 11*a* is provided with a smoothly finished surface in addition to being rounded so as to keep ribbon 18 away from the interior surface of wall 11*b*, to reduce the engagement of inked ribbon 18 with portions of the cartridge housing lower half 11 to a practical minimum. The ribbon 18 thereby passes through inlet opening O-2, slides past projection 11*q* and moves about post 11*r* which is integrally joined to and extends upwardly from the base portion 11*a* of the cartridge housing lower half 11. An arcuate shaped projection 11*s* is arranged to the right-hand side of post 11*r* to prevent the ribbon 18 from moving into the region R5 between the idler roller assembly 22 and the interior surface of outer wall 11*b* so as to prevent the ribbon 18 from becoming "jammed" or "snagged" within region R5.

The use of a Mobius loop causes the inked ribbon 18 to be "flipped over" once during each revolution of the ribbon 18 through the printing station P so that printing occurs over the bands B1 and B2 of the ribbon 18. This printing arrangement is obtained since the print wires W are not centered relative to the edges of the ribbon 18 but are set above the ribbon longitudinal center line thereby providing more even wearing of the ribbon 18, i.e., a more even usage of the ink in which the ribbon fabric has been saturated.

Since the ribbon 18 is fully self-contained within the cartridge assembly 10 together with the drive assembly 13 and the guiding arrangement 14, mounting of the cartridge assembly 10 upon the printer carriage assembly is quite simple and requires only one very easy threading operation in which the portion of the ribbon 18 extending across the printing station P is guided between the front of the print head nose 15*a* and the paper document 17. In some instances a thin guide plate 15*d* is positioned across the front of the print head nose portion 15*a* and the ribbon 18 need only be guided between the guide plate 15*d* and the nose 15*a* of the print head assembly 15. By gripping and twisting the knurled knob portion 23*a*, the rectangular shaped bore 23*f* may be quickly and easily brought into alignment with the rectangular shaped projection 25*a* provided on the ribbon drive shaft 25 to facilitate alignment therebetween.

The cover or lid 12 is preferably secured upon the housing lower half 11 by means of projecting pins (not shown) provided at spaced locations about the periphery of the cover 12 and slightly inwardly spaced therefrom, each pin adapted to be received by one of the bores $S_1$ arranged at spaced locations along the upper edges of the outer and inner side walls 11*b* and 11*c*. The pins are preferably force-fittingly received within the bores $S_1$ in the side walls 11*b* and 11*c* to thereby secure the cover plate 12 to the housing lower half 11. The cartridge assembly 10 may be removed from the printer carriage assembly and discarded when the inked ribbon 18 is exhausted and replaced by a fresh cartridge assembly 10. Although the components forming the cartridge assembly 10 are relatively inexpensive, they are molded or otherwise formed so as to yield an assembly whose precision is more than sufficient to assure high-quality, trouble-free performance. The use of an inked ribbon 18 which is "stuffed" (i.e., driven) into the storage regions in full-fan-fold fashion permits more ribbon density per given volume (i.e., more linear length of ribbin 18 per storage region) than random fold or coiled ribbon cartridges so as to significantly increase the useful operating life of a cartridge assembly 10, thereby reducing the amount of cartridge changes required.

The full-fan-fold arrangement assures a neat and orderly movement of the ribbon 18 through the cartridge storage regions thereby, for the first time, permitting the use of a substantially U-shaped storage regions which further contributes to the increased storage capacity of the cartridge assembly 10.

The cartridge assembly 10 is designed to significantly reduce the total amount of surface area sliding engagement between the ribbon 18 and the cartridge assembly 10 to a practical minimum, which serves to significantly reduce the number of possible "snags" which might occur during a ribbon feeding operation. The unique design of the outfeed end 0 of the storage regions assures feeding of the ribbon 18 in a smooth fashion and this arrangement, together with the overlapping arrangment of the projections 19*a* and 19*b* (see FIG. 2*c*), which imposes sufficient "drag" upon the ribbon 18, cooperates to provide a smooth feeding of the ribbon 18 from the outfeed end 0 of the storage regions and across the print station P.

While the invention has been described with a certain degree of particularity, it will be understood that the description was by way of example only and that numerous variations and modifications, as may become apparent to those of ordinary skill in the art, can be made without departing from the spirit and the scope of the invention as hereinafter claimed.

What is claimed is:

1. A ribbon cartridge for use in printers having a print head assembly including a nose, and a paper support movable relative to one another to effect printing at a printing location by printing means located at the nose of the print head assembly, said cartridge comprising:

a closed loop of ribbon;

a housing having a hollow interior, a portion of said interior forming a substantially U-shaped ribbon storage region having inlet and outlet ends at the opposite ends of said U-shaped storage region and being defined by top and bottom walls joined by spaced-apart inner and outer U-shaped side walls;

drive means forming part of said cartridge at the inlet end of said storage region for driving the ribbon into the storage region to engage stripper means for imparting to the ribbon a full fan-fold configuration whereby opposite folds of ribbon extend towards said inner and outer side walls of said housing;

the inlet and outlet ends of said ribbon storage region being substantially coplanar and on opposite sides of the nose of said print head assembly;

said housing also including a hollow ribbon guiding channel spanning between and being substantially coplanar with said outlet and inlet ends of said storage region for guiding said ribbon from said outlet end to said ribbon driving means, said guiding channel having an opening coinciding with the position occupied by the nose of the print head assembly to expose a portion of the ribbon extending across the guiding channel for engagement by said printing means;

said spaced-apart inner and outer U-shaped side walls being spaced apart a sufficient distance to receive said ribbon in said full fan-fold configuration from said inlet end to said outlet end;

means located at the outlet end of said storage region for guiding the ribbon out of said storage region and including a first opening through which said ribbon passes and second and third openings on opposite sides of said first opening for accommodating opposite folds of the stored fan-fold ribbon in an alternating fashion as the ribbon is drawn through said first opening by said drive means, said first opening being defined by first and second spaced-apart projections arranged intermediate the side walls of the housing;

a third projection extending inwardly from said inner side wall towards said first projection to define said second opening;

a fourth projection extending inwardly from said outer side wall towards said second projection to define said third opening, the distance measured across said first opening being significantly greater than the thickness of the ribbon and being so constructed to prevent the ribbon from being creased in the event that multiple plies of the ribbon pass therethrough; and said guiding channel and said U-shaped storage region cooperating to form a central opening for surrounding said print head assembly and the nose of said print head assembly.

2. A ribbon cartridge for use in printers having a print head assembly including anose and a paper support, said assembly and support being movable relative to one another to effect printing by printing means located at the nose of the print head assembly, said cartridge comprising:

a closed loop ribbon;

a housing having a hollow interior, a portion of said interior forming a ribbon storage region having inlet and outlet ends and being defined by top and bottom walls joined by substantially parallel inner and outer side walls;

drive means forming part of said cartridge at the inlet end of said storage region for driving the ribbon into the storage region so that the ribbon is stored in a full fan-fold configuration whereby opposite folds of ribbon extend towards said inner and outer side walls of said housing;

said housing also including a hollow ribbon guiding means for guiding the ribbon between the outlet and inlet ends of said storage region; and means located at the outlet end of said storage region for guiding the ribbon out of said storage region and including a first opening through which said ribbon passes, second and third openings on opposite sides of said first opening for accommodating opposite folds of the ribbon in an alternating fashion as the ribbon is drawn through said first opening by said drive means, said first opening being defined by first and second spaced-apart projections arranged intermediate the side walls of the housing; a third projection extending inwardly from said inner side wall towards said first projection to define said second opening; and a fourth projection extending inwardly from said outer side wall towards said second projection to define said third opening, the distance measured across said first opening being significantly greater than the thickness of the ribbon and being so constructed to prevent the ribbon from being creased in the event that multiple plies of the ribbon pass therethrough.

* * * * *